US005940094A

United States Patent [19]

Otsuka et al.

[11] Patent Number: 5,940,094

[45] **Date of Patent: *Aug. 17, 1999**

[54] RECORDING APPARATUS AND METHOD HAVING A TEMPERATURE OVERRISE PROTECTION FUNCTION

[75] Inventors: Naoji Otsuka; Tetsuo Suzuki; Kentaro Yano, all of Yokohama; Kiichiro Takahashi; Osamu Iwasaki, both of Kawasaki; Daigoro Kanematsu, Yokohama, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/507,081

[22] Filed: Jul. 26, 1995

[30] Foreign Application Priority Data

Jul. 29, 1994 [JP] Japan ..... 6-179208

[51] Int. Cl.[6] ..... B41J 29/38

[52] U.S. Cl. ..... 347/17; 347/14

[58] Field of Search ..... 347/14, 17, 20, 347/23, 29

[56] References Cited

U.S. PATENT DOCUMENTS

| | | | |
|---|---|---|---|
| 4,313,124 | 1/1982 | Hara . | |
| 4,345,262 | 8/1982 | Shirato et al. . | |
| 4,459,600 | 7/1984 | Sato et al. . | |
| 4,463,359 | 7/1984 | Ayata et al. . | |
| 4,558,333 | 12/1985 | Sugitani et al. . | |
| 4,608,577 | 8/1986 | Hori . | |
| 4,723,129 | 2/1988 | Endo et al. . | |
| 4,740,796 | 4/1988 | Endo et al. . | |
| 4,791,435 | 12/1988 | Smith et al. . | |
| 4,910,528 | 3/1990 | Firl et al. | 346/1.1 |
| 5,166,699 | 11/1992 | Yano et al. | 346/1.1 |
| 5,502,469 | 3/1996 | Watanabe | 347/14 |
| 5,579,039 | 11/1996 | Kurata et al. | 347/49 |
| 5,585,825 | 12/1996 | Kneezel et al. | 347/14 |

FOREIGN PATENT DOCUMENTS

| | | |
|---|---|---|
| 0374762 | 6/1990 | European Pat. Off. . |
| 0496525 | 7/1992 | European Pat. Off. . |
| 54-056847 | 5/1979 | Japan . |
| 59-123670 | 7/1984 | Japan . |
| 59-138461 | 8/1984 | Japan . |
| 60-071260 | 4/1985 | Japan . |

*Primary Examiner*—Safet Metjahic
*Assistant Examiner*—John Chizmar
*Attorney, Agent, or Firm*—Fitzpatrick, Cella, Harper & Scinto

[57] ABSTRACT

When it is determined that a temperature of a recording head exceeds a predetermined temperature, a head exchange inhibit mode shift flag is set. Thus, even if an input to command the exchange of the recording head which is at a high temperature is made, the exchange operation is inhibited or the exchange is disabled.

42 Claims, 9 Drawing Sheets

RECORDING APPARATUS AND METHOD HAVING A TEMPERATURE OVERRISE PROTECTION FUNCTION

BACKGROUND OF THE INVENTION

1. Field of the Invention

The present invention relates to recording apparatus and method, and more particularly to temperature control and accompanied process, particularly temperature overrise protection, in the recording apparatus.

2. Related Background Art

A recording apparatus used in a printer, a copying machine and a facsimile machine is constructed to record an image comprising a dot pattern on a recording medium such as a paper or a plastic thin sheet in accordance with recording information. Such recording apparatus may be classified by recording systems thereof into ink jet system, wire dot system, thermal transfer system and laser beam system. Of those, the ink jet system recording apparatus discharges ink droplets (recording liquid) from discharge ports (outlets or orifices) provided in a head and deposits them to a recording medium to record an image and it has been widely used because it satisfactorily meets general requirements of high speed recording, high resolution recording, high grade recording and low noise recording.

As a general construction to meet the above requirements, a higher head drive frequency and a larger number of recording elements are used. In such a case, an energy applied to the recording head remarkably increases.

Particularly, in the ink jet system in which air bubbles are generated in ink by using thermal energy to discharge ink droplets, this tendency is remarkable. For example, in the recording apparatus, a member for mounting a recording head, an ink tank, and a member for supplying ink serve to emit heat by the energy application, and when the drive frequency is doubled while a volume and a surface area of those members are kept fixed, a relatively double energy would be applied. When the number of discharge ports is doubled, a double energy would be applied, similarly. In actuality, when the number of recording elements or discharge ports is increased, a volume near the discharge ports increases but a volume of other parts and a surface area thereof do not significantly increase. Thus, in the above case, approximately four times energy would be applied to the substantially constant volume and surface area.

In this case, for the ink jet system using the thermal energy, several tens percent of the applied energy is emitted out of the recording head by a kinetic energy to discharge the ink and heat generation by the discharged ink. Thus, approximately two times temperature rise is generated in the recording head by the application of the four times energy.

However, the temperature rise in such a recording head raises the following two problems.

A first problem is due to the fact that the temperature of the recording head rises high by the approximately two times temperature rise.

For example, when recording is made at a relatively high recording duty in an environment temperature of 30° C., a temperature in the apparatus rises approximately 10° C. by the temperature rise of a power supply, a motor and a driver in the recording apparatus. In this case, if a recording head with a relatively low drive frequency and a relatively small number of discharge ports is used, the temperature rise will be approximately 25° C. even for full painting or 100% duty recording, but when the drive frequency is doubled and the number of discharge ports of the recording head is doubled, the temperature rise will be double, that is, approximately 50° C. By summing the environment temperature and the temperature rises, the temperature of the recording head is approximately 65° C. for the low drive frequency and the small number of discharge ports while it is approximately 90° C. for the high drive frequency and the large number of discharge ports.

When the temperature of the recording head reaches approximately 90° C., the failure of discharge is apt to occur. Further, in an apparatus in which the recording head is exchangeable or it may be touched by a user, it is necessary to pay attention to prevent the user from touching the recording head while the recording head is at a high temperature.

A second problem relates to a break mode of the recording head.

As explained above, the recording head temperature may reaches 90° C. depending on the recording status. In this case, even if four times energy is applied to the recording head, the temperature rise thereof is approximately two times because several tens percent of energy is ejected out of the recording head as the thermal and kinetic energies when the ink is discharged. However, although the operation is that described above when the ink is normally discharged, when the ink is not supplied to the recording head when an ink tank is empty and no ink to be discharged is present or when air bubbles stay in an ink supply path to block the supply of the ink, a so-called empty heat state in which the recording head is driven without ink takes place.

In this case, since four times energy is supplied with no ink discharged in the above example, the energy for the discharge of the ink causes the abrupt rise of the temperature of the recording head so that the temperature of the recording head reaches one hundred and several tens °C. As a result, plastic parts of the recording head exceed a thermal deformation temperature and they may be deformed, adhered portions may be torn off by the abrupt thermal expansion or the ink remaining near the heater is burnt making the heater inoperable.

The break mode which is inherent to the ink jet system is different from a break mode in the conventional thermal transfer system or wire dot system in which the temperature gently rises by the continuous recording to cause the break due to the temperature overrise determined by a heat capacity of the recording head unit. The existence of such a break mode makes difficult the solution by various countermeasures for the conventional break mode.

SUMMARY OF THE INVENTION

It is an object of the present invention to provide recording apparatus and method which allows to prevent abrupt overrise of temperature which leads to the break of a recording head per se.

It is another object of the present invention to provide recording apparatus and method which allows to prevent a user from touching a recording head which is at a high temperature.

In order to achieve the above objects, the present invention provides a recording apparatus for recording on a recording medium by using an exchangeable recording head, comprising acquire means for acquiring temperature information of the recording head, determination means for determining whether a head temperature value derived based on the temperature information of said recording head acquired by said acquire means is above a predetermined value or not, and mode setting means for setting a mode to inhibit an exchange operation of said recording head when said determination means determines that the temperature of said recording head is above the predetermined value.

The present invention further provides a recording apparatus for recording on a recording medium by using an exchangeable recording head, comprising acquire means for acquiring temperature information of the recording head, determination means for determining whether a head temperature value derived based on the temperature information of said recording head acquired by said acquire means is above a predetermined level represented by a temperature at which said recording head is protected less a maximum temperature rise in one line of recording by the movement of said recording head or not, and control means for relatively reducing an energy per unit time applied to the one line of recording when said determination means determines that the temperature value of said recording head is above the predetermined level.

The present invention further provides a recording method for recording on a recording medium by using an exchangeable recording head, comprising the steps of acquiring temperature information of the recording head, determining whether a head temperature value derived based on the temperature information of said recording head acquired by said acquire means is above a predetermined value or not, and setting a mode to inhibit an exchange operation of said recording head when said determination step determines that the temperature of said recording head is above the predetermined value.

The present invention further provides a recording method for recording on a recording medium by using an exchangeable recording head, comprising the steps of acquiring temperature information of the recording head, determining whether a head temperature value derived based on the temperature information of said recording head acquired by said acquire step is above a predetermined level represented by a temperature at which said recording head is protected less a maximum temperature rise in one line of recording by the movement of said recording head or not, and relatively reducing an energy per unit time applied to the one line of recording when said determination step determines that the temperature value of said recording head is above the predetermined level.

In accordance with the present invention, when the recording head reaches a relatively high temperature above a predetermined temperature, the exchange of the recording head is inhibited. Further, when the recording head reaches a high temperature, a drive duty of the recording head is reduced.

DETAILED DESCRIPTION OF THE PREFERRED EMBODIMENTS

Referring to the accompanying drawings, embodiments of the present invention will be explained.

Embodiment 1

Before the prevention of the break of the recording head by the temperature overrise of the ink jet printer and the user protection sequence in exchanging the recording head in accordance with one embodiment of the present invention, a schematic construction of the printer is explained.

Figure 1:
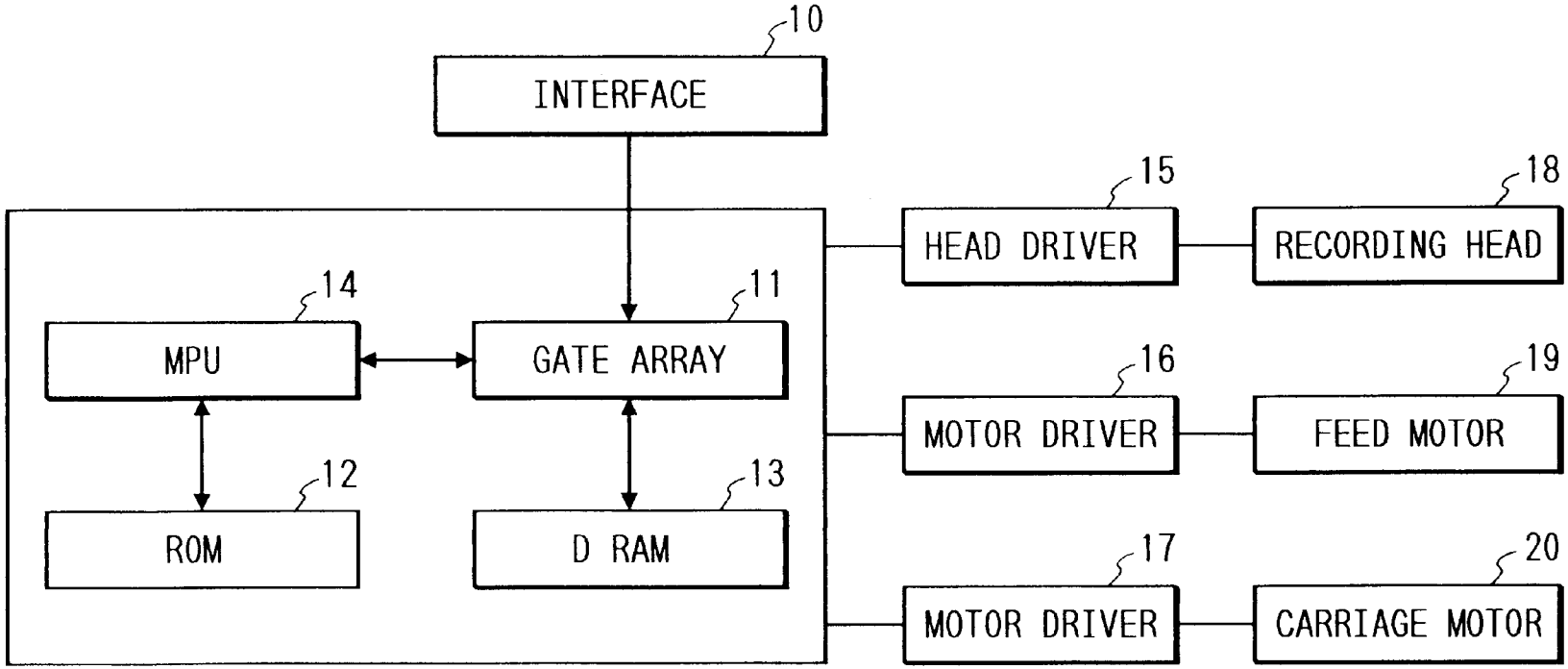
FIG. 1 shows a block diagram of a control scheme of an ink jet recording apparatus in accordance with one embodiment of the present invention.

FIG. 1 shows a block diagram of a control scheme of the printer in accordance with the embodiment of the present invention.

Respective elements in FIG. 1 are first explained. Numeral 10 denotes an interface, numeral 11 denotes a gate array, numeral 12 denotes a ROM, numeral 13 denotes a dynamic RAM (hereinafter referred to a DRAM), numeral 14 denotes an MPU for controlling the entire apparatus and processing data, numeral 15 denotes a head driver for driving a recording head, numeral 16 denotes a sheet feed motor driver for driving a feed motor 19, and numeral 17 denotes a motor driver for driving a carrier motor 20.

In the above arrangement, when record data is sent from a host unit, not shown, through the interface 10, the record data is temporarily stored in the DRAM 13 by the gate array 11. The stored data is then converted by the gate array 11 from a form of raster data to a form of print image data to record by the recording head 18 and it is again stored in the DRAM 13. The data stored in such a form is DMA transferred to the head driver 15 through the gate array 11 by a start of record signal. Thus, ink is selectively discharged from discharge ports of the recording head 18 to record an image. A hardware counter for counting the recorded dots in recording is arranged on the gate array 11 so that the number of recorded dots is counted at a high speed. The carriage 20 is driven through the motor driver 17 and it drives the recording head 18 along a main scan direction in synchronism with a discharge timing of the recording head 18.

Figure 2:
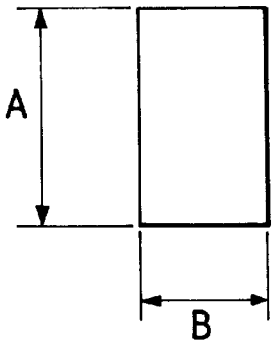
FIG. 2 shows a record range for determining a recording duty in the embodiment of the present invention.

In the recording sequence, the MPU 14 interrupts the gate array 11 at 10 msec intervals to read the count of the counter for the recorded dots. Thus, the number of dots recorded in a unit time, that is, a recording duty is detected. More specifically, as shown in FIG. 2, assuming that a recording head having a 128-discharge port width (A in the figure) is used and the recording is made at a drive frequency of 6.25 KHz, the carriage is advanced by 63 dots in 10 msec if the resolution is same for the main scan direction and the sub-scan direction and the number of recorded dots may be counted to detect the recording duty within this range (B in the figure).

Figure 3:
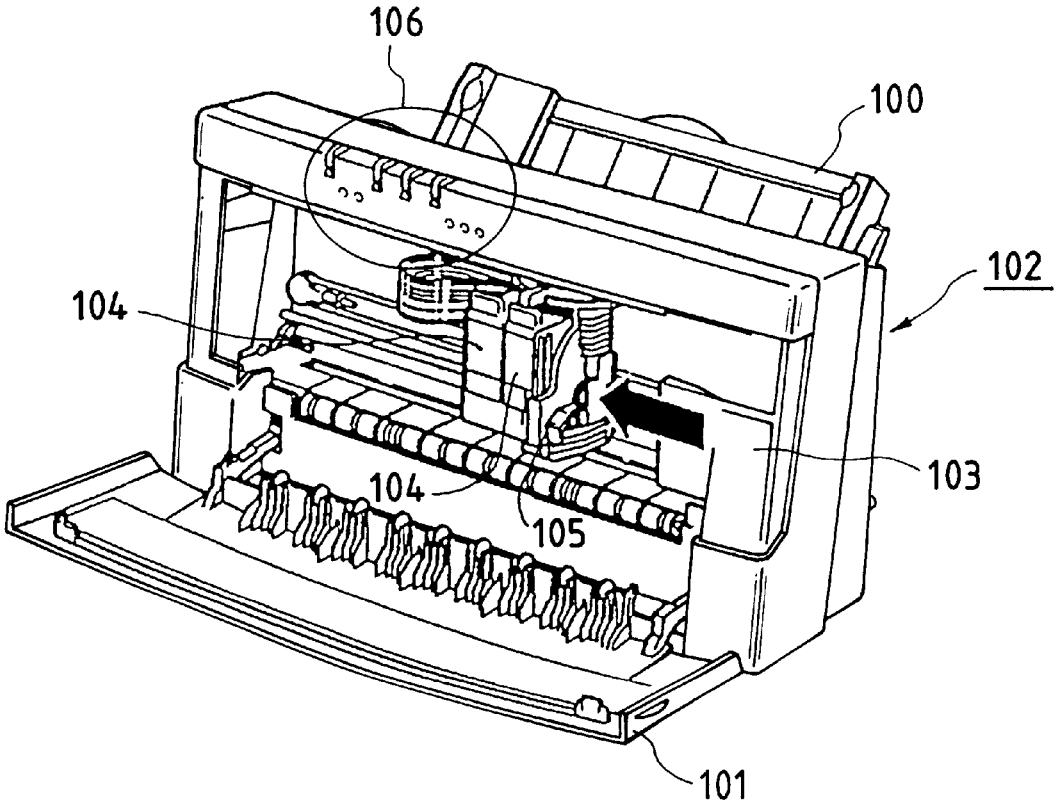
FIG. 3 shows a perspective view of the ink jet recording apparatus of the embodiment of the present invention.

FIG. 3 shows a perspective view of the printer in the present embodiment.

In FIG. 3, a predetermined key of a console key unit 106 is operated to indicate that a head cartridge 104 has been move to an exchange position. Numeral 102 denotes a printer main body and numeral 100 denotes an ASF unit arranged at the rear of the main unit to automatically feed a sheet. The recording sheet as a recording medium fed from the ASF unit 100 is fed to the front of the printer main unit through the center of the printer main unit during which ink is discharged from the recording head 18 of the head cartridge 104. In this manner, the recording is made and the recording sheet ejected to the front of the apparatus is received by a tray which forms a front cover 101.

Figure 4:
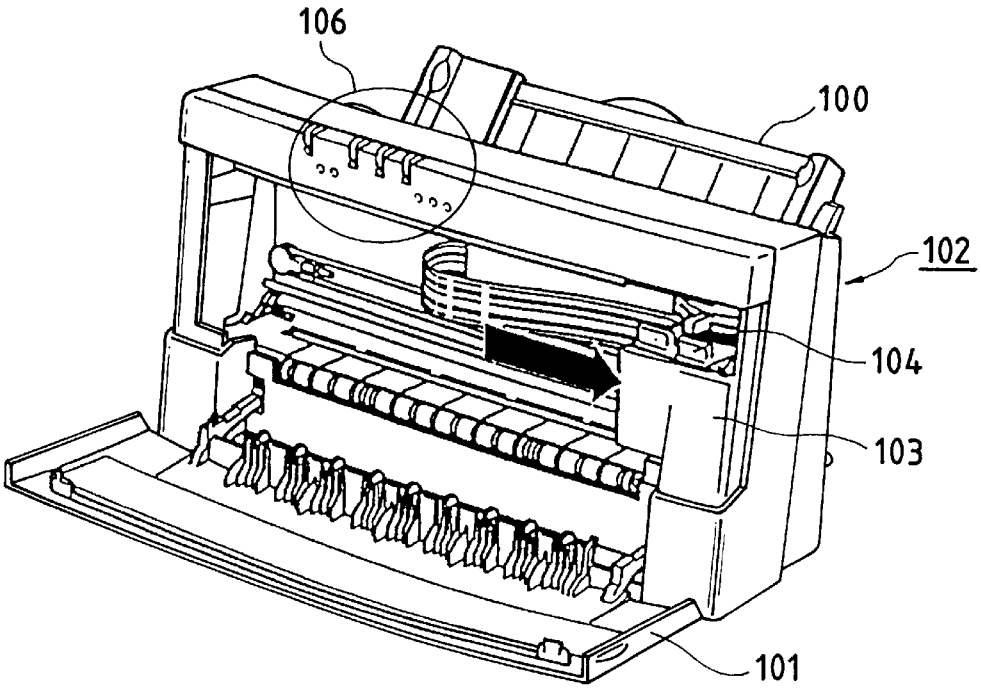
FIG. 4 shows a perspective view illustrating a cartridge exchange inhibit mode of the apparatus.

As shown in FIG. 4, when the cartridge 104 is near a home position thereof, a substantially entire area thereof is covered by a barrier member 103. Particularly, a lever 105 (see FIG. 3) for attaching and removing the head is completely hidden by the member 103 so that it cannot be manipulated.

Figure 5:
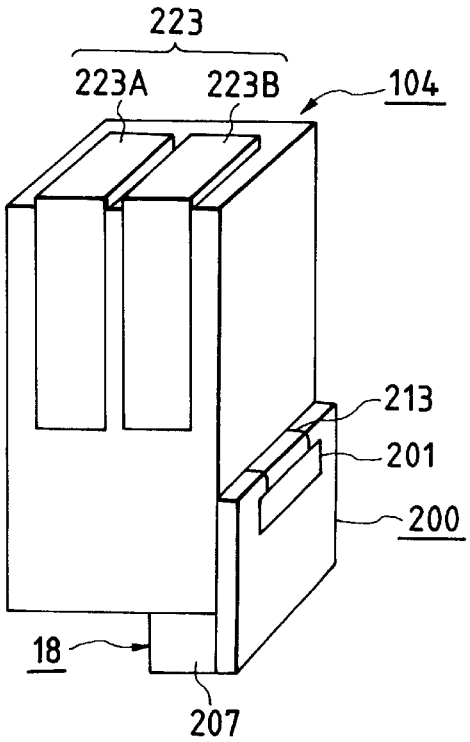
FIG. 5 shows a perspective view of a head cartridge used in the apparatus.

FIG. 5 shows a perspective view of the head cartridge 104.

Figure 6:
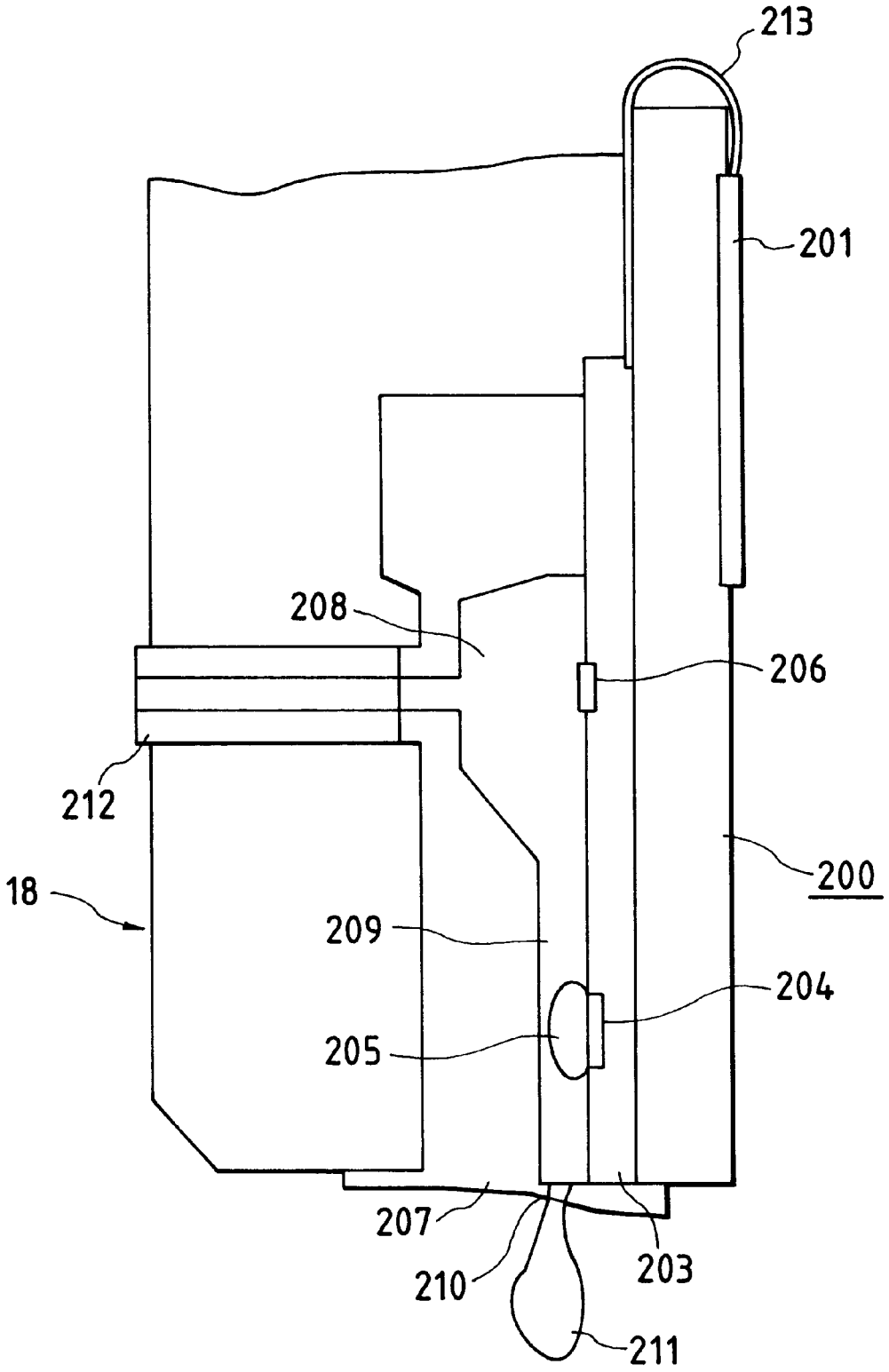
FIG. 6 shows a sectional view of a recording head structure used in the apparatus.

The head cartridge 104 comprises the recording head 18 and an ink tank 203. The recording head 18 is formed by joining an aluminum base plate 200 and a top plate 207 as shown in FIG. 6. A contact plane 201 is arranged on one side of the base plate 200 and it is electrically connected to a matrix wiring in the ink jet recording head through a flexible cable 213. Numeral 223 denotes an ink tank which comprises, in the present embodiment, a black ink tank 223A and a tank 223B having cyan, magenta and yellow chambers separated therein, and the ink tank is exchangeable.

FIG. 6 shows a sectional view of detail of the ink jet recording head shown in FIG. 5.

A heater board 203 made of silicon is bonded on the base plate 200. An ink discharging heater 204 and a diode temperature sensor 206 are formed on the heater board 203 by a semiconductor film forming process. A grooved top plate 207 is press-fitted to the heater board to form a common liquid chamber 208 and a plurality of liquid paths 209. The common liquid chamber 208 forms a space to temporarily store the ink flowing into through an ink supply path 212 and the stored ink is supplied to the respective liquid paths 209 depending on the output state. A plurality of liquid paths 209 and corresponding discharge ports 210 are arranged perpendicularly to the plane of the drawing for each of the ink colors, black, cyan, magenta and yellow.

The top plate 207 has a groove for the liquid path common liquid chamber and it is of relatively complex shape and formed by precise plastic molding. A material for the top plate may be a molding material such as polysulfon which has a good molding property, is highly resistive to chemicals and relatively highly resistive to high temperature. Numeral 205 denotes bubbles generated in the ink by the heat generated by a discharging heater 204 and ink droplets 211 are discharged thereby from discharge ports 210.

A sequence of the present embodiment for the temperature rise of the head of the printer is now explained.

Figure 7:
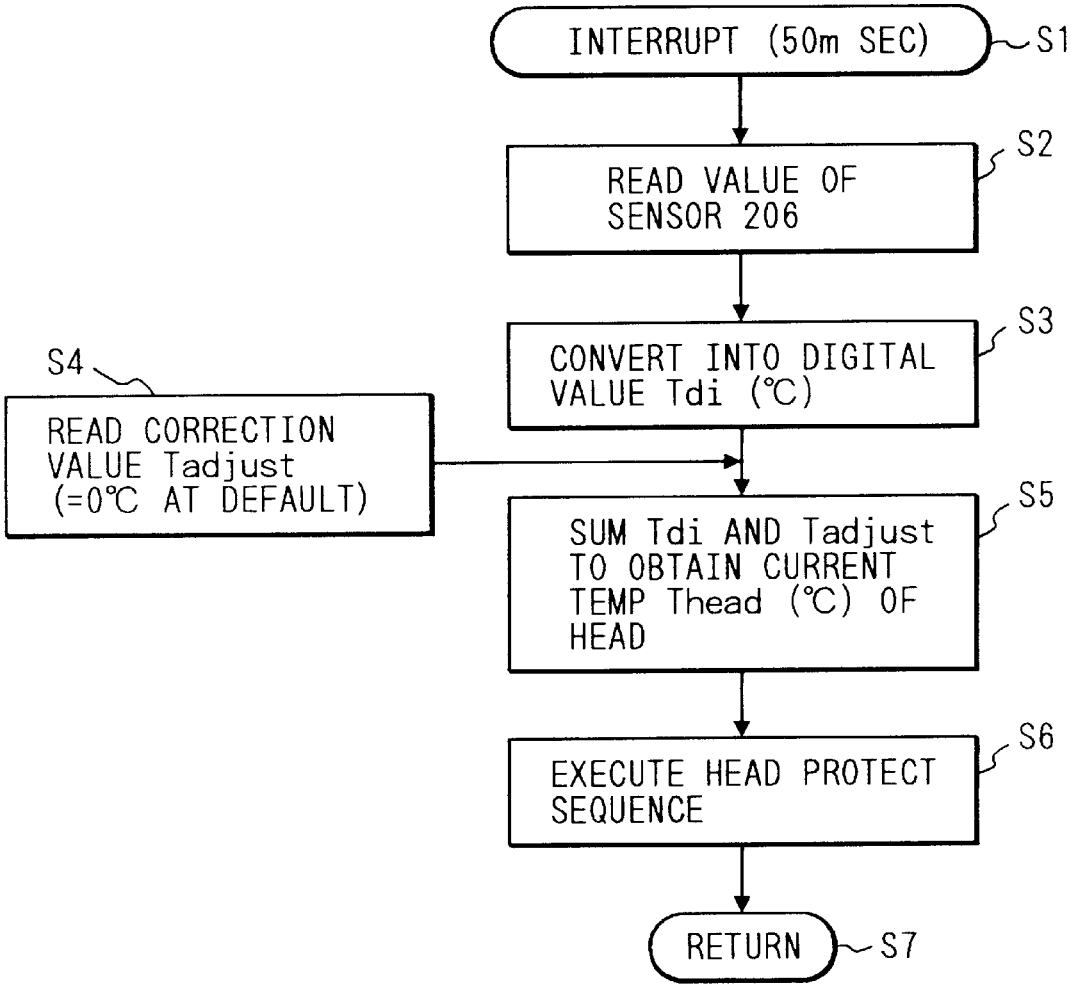
FIG. 7 shows a flow chart of a head protect control main routine in the embodiment of the present invention, FIG. 8, comprised of FIG. 8A and FIG. 8B, shows a flow chart of a head protect sequence of the routine.

FIG. 7 shows a flow chart of a head protect control main routine of the present embodiment.

In the printer of the present embodiment, various controls to the recording head are basically conducted by timer interruption. The head protect control of the present embodiment is also basically conducted by the interruption to the CPU. Namely, the head protect control main routine is conducted by the interruption at the interval of 50 msec. The present process is started by the 50 msec interval interruption in a step S1, and the signal value is read from the diode temperature sensor 206 of the recording head 18 in a step S2. In a step S3, the signal value is AD converted to generate a digital signal Tdi-°C. In a step S4, a room temperature compensation value for the detection value of the diode temperature sensor 206 of the recording head 18 is read. This may be done only when the room temperature compensation is required by storing various values generated in various known methods in a memory and reading it. In a step S5, the compensation value is added to the temperature data to produce a current recording head temperature. In a step S6, the process shifts to a sub-routine of a head protect sequence which will be described in detail in conjunction with FIGS. 8A and 8B.

Figure 8A:
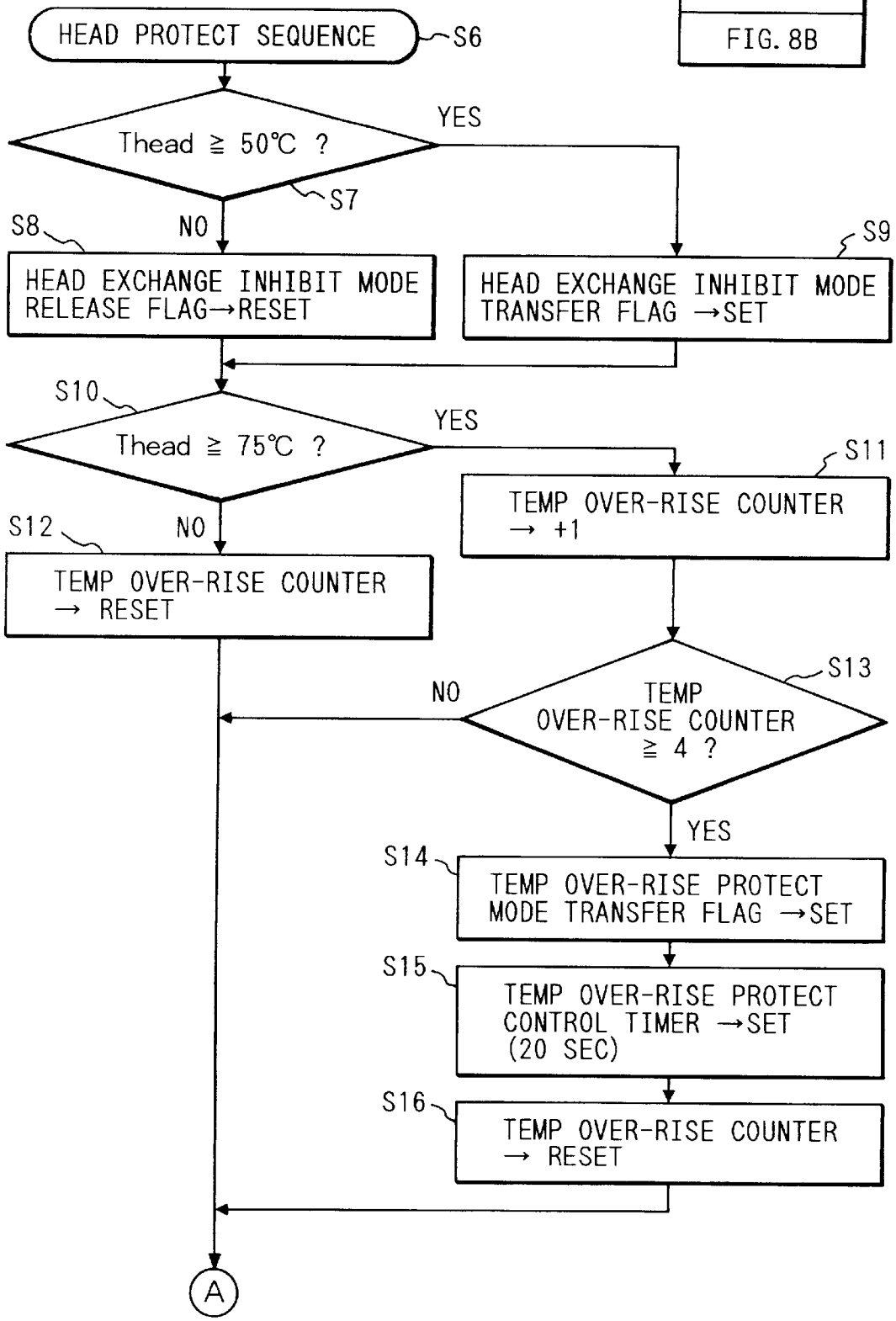
Figure 8:
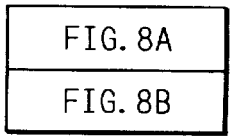
Figure 8B:
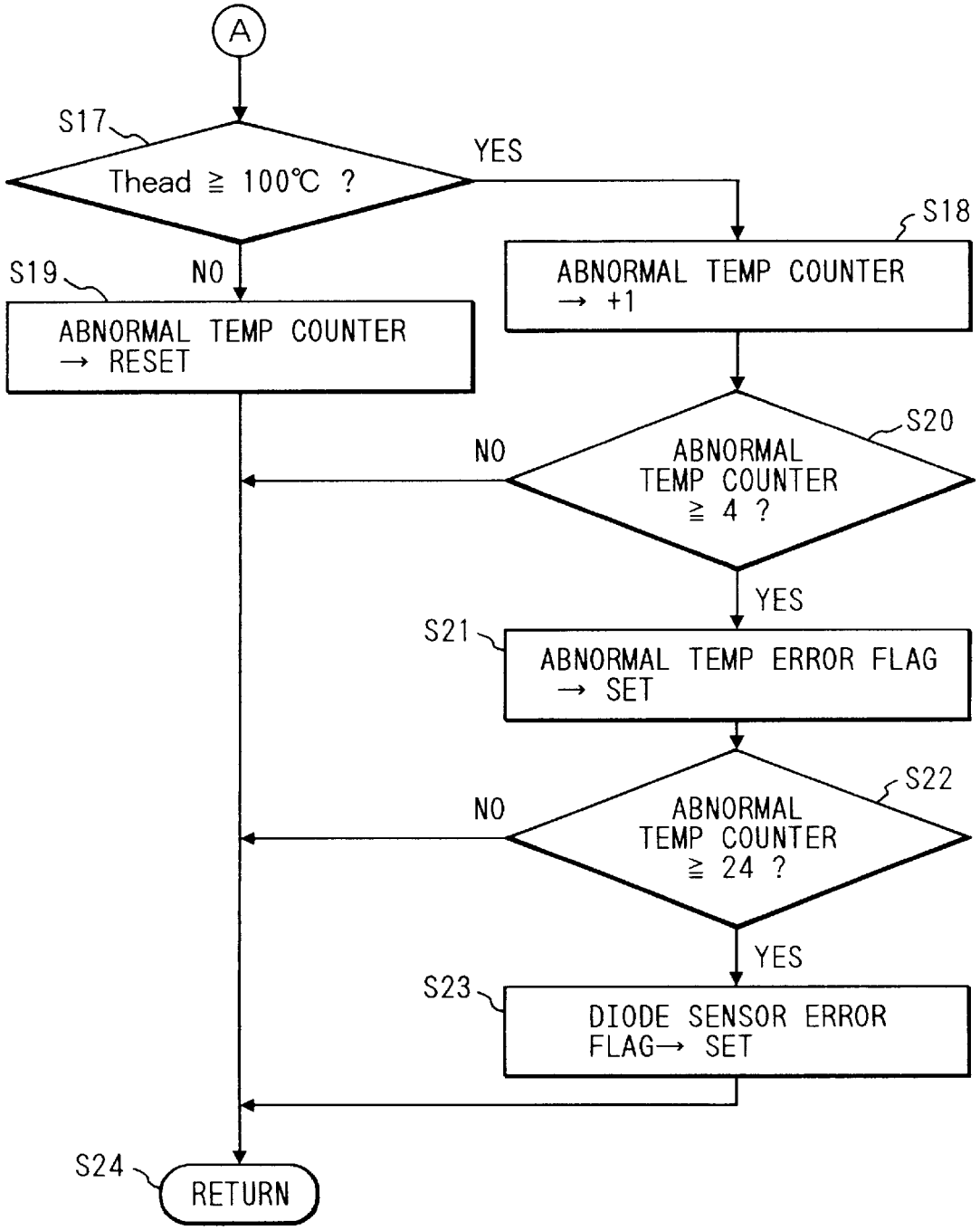

FIGS. 8A and 8B show flow charts of the sub-routine of the head protect sequence of the step S6.

In a step S7, whether the temperature of the recording head 18 is above 50° C. or not is determined. If it is above, it is flagged in a step S9 to shift the process to a head exchange inhibit process when a head exchange request is entered by the key operation. If the decision in the step S7 is negative, a head exchange inhibit mode flag is reset in a step S8, and in a step S10, whether the head temperature is above 75° C. or not is determined. If it is above, a content of a temperature overrise counter is incremented in a step S11.

The content of the temperature overrise counter is incremented each time the head temperature is determined to be above 75° C. at 50 msec interval interruption. If it is incremented four times continuously, the count-up is detected in a step S13 and a branch is made to carry out the temperature overrise protect operation (steps S14 to S16). This is a hysteresis loop to determine that the temperature is above 75° C. only when the state of above 75° C. for longer than 0.2 sec is detected. In this manner, the activation of the protect operation by an instantaneous noise or an instantaneous temperature rise and resulting reduction of throughput are prevented.

If the temperature is below 75° C. in the decision of the step S10, the temperature overrise counter is reset in a step S12.

In a step S13, if the count of the counter is 4 or larger indicating the temperature overrise, the process proceeds to a step S14 to set a flag to move to a temperature overrise protect mode. In a step S15, a temperature overrise protect control timer for controlling a time to conduct the temperature overrise protect operation is set. In the present embodiment, this time is set to 20 seconds. Then, in a step S16, the temperature overrise counter is reset.

In a step S17, whether the temperature of the head is above 100° C. or not is determined. If it is above 100° C., an abnormal temperature counter is incremented in a step S18. In the same principle as that for the temperature overrise counter, the temperature overrise is detected in a step S20 if the temperature is above 100° C. four times continuously, and a temperature overrise error flag is set in a step S21. In a step S22, if the temperature is above 100° C., 24 times continuously, it is determined as an error of the diode temperature sensor and a head diode sensor error flag is set in a step S23. The counter is incremented at a 50 msec interval interruption 24 times, and when 20 times or one second elapses from the determination of the temperature overrise error, the diode temperature sensor error is detected.

By repeating the series of steps described above, the decision is made in the flow chart of 50 msec interruption for the respective states of the recording head, the corresponding heads are set and the corresponding processes are conducted in the corresponding sub-routines.

Figure 9:
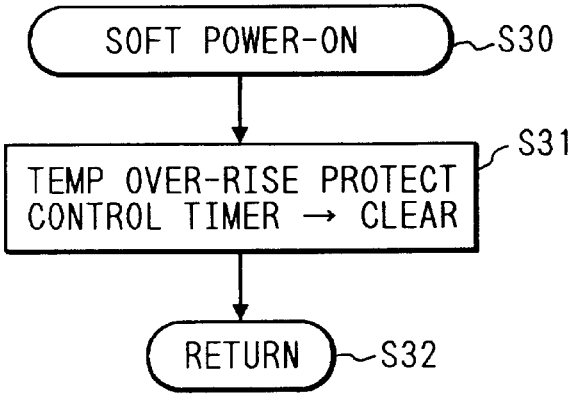
FIG. 9 shows a flow chart of a temperature overrise protect control timer clear routine in the head protect sequence.

FIG. 9 shows a flow chart of a power-on interruption process as an exceptional process.

When power is turned on, the interruption of a step S30 is started as an initial operation and the temperature overrise protect control timer is cleared in a step S31.

Figure 10:
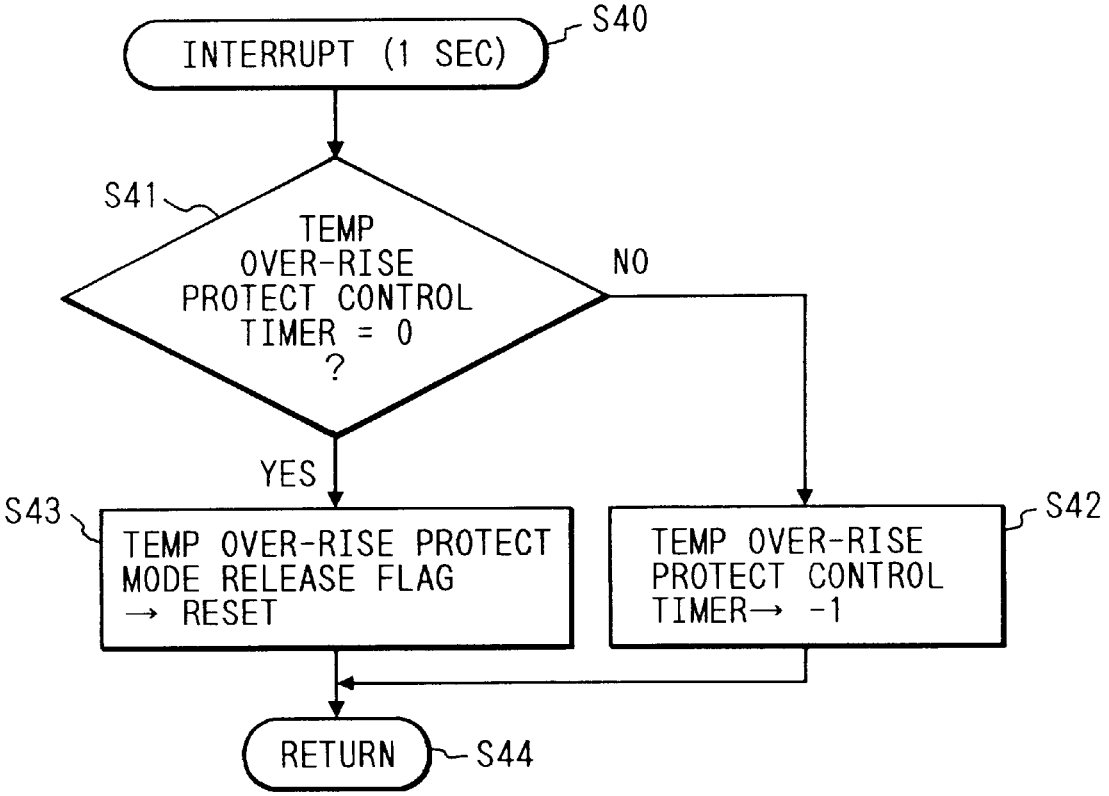
FIG. 10 shows a flow chart of an update routine of the temperature overrise protect control timer.

FIG. 10 shows a flow chart of an update routine of the temperature overrise protect control timer.

The interruption of the control is conducted at 1 sec interruption timing in a step S40. The content of the protect control timer is read in a step S41, and if it is not 0 sec, it is determined that the counting is in process and the temperature overrise protect timer is decremented in a step S42. If the content of the temperature overrise protect control timer is 0 in the step S41, the temperature overrise protect mode flag is reset in a step S43 and the process returns in a step S44. Through this process, the temperature overrise protect is released in 20 seconds.

Figure 11:
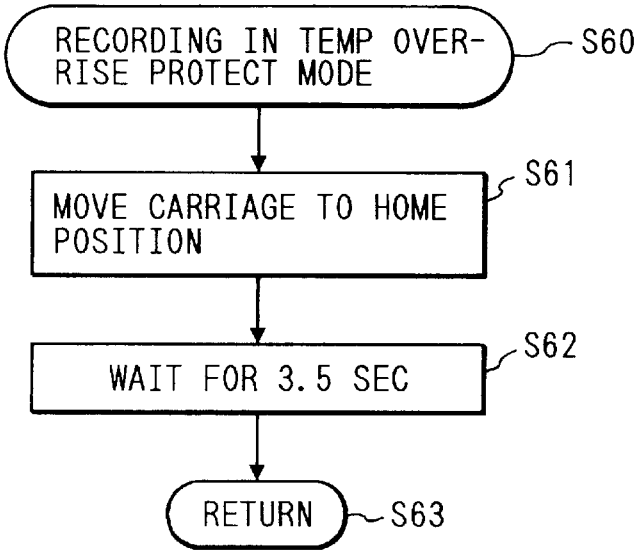
FIG. 11 shows a flow chart of a record routine of the temperature overrise protect mode.

FIG. 11 shows a flow chart of a sub-routine of the recording in the temperature overrise protect mode.

When the temperature overrise is detected and the recording is to be made, this sub-routine is started. For each one line of recording, a carriage is moved to a home position in a step S61, the process waits for 3.5 seconds in a step S62, and it returns in a step S63. Through this process, the substantial recording duty is reduced as converted to a mean duty per unit time to prevent the temperature rise. The method to reduce the substantial recording duty is not limited to the above but other known processes may be used. For example, the number of discharge ports to be used may be reduced and the divisional recording may be conducted, or the drive frequency may be reduced for recording.

As described above, when the temperature of the recording head exceeds 50° C. by the rise of the temperature of the recording head, the head exchange inhibit mode is rendered valid and the recording is continued. When the recording is continued at the high recording duty and the temperature rises to 75° C., the head exchange inhibit mode as well as the temperature overrise protect operation are rendered valid to prevent the recording head from being broken or the record failure from taking place. When the head temperature further rises or the temperature rises unexpectedly to exceed 100° C., the temperature overrise error is rendered valid to set the system to the error mode to stop the recording. When the temperature still further rises, it is determined that the diode temperature sensor has failed and the diode sensor error is set. In this manner, the printer is controlled in multi-stage by the temperature detected for the recording head. Thus, the protection for the temperature overrise is attained without reducing the recording throughput as much as possible. The significance of the setting of the respective determination temperatures is explained below.

In the so-called bubble jet system in the present embodiment, as shown in FIG. 6, a pulse current is supplied to a heater 204 to instantaneously heat the ink to cause a film boiling state and the ink in the liquid path 209 is pushed out by the air bubbles 205 generated thereby to form the discharged ink droplets 211. In discharging the ink, an electrical energy supplied to the heater 204 is not 100% converted to a kinetic energy but most of the energy is dissipated as a thermal energy. Approximately one half of the heat is emitted out of the recording head together with the discharged ink droplets and the remaining one half is stored in the recording head. Namely, it is conducted through the entire recording head including the heater board 203, the base plate 200 and the grooved top plate 207 and even the ink tank so that the heat is dissipated from those members to the air as the heat is conducted.

When the heat is stored in this manner, the temperature rise is particularly remarkable on the rear side of the aluminum base plate 200 which has a relatively high thermal conductivity. When the drive frequency is low and the number of discharge ports is small, the temperature by the temperature rise does not cause a problem by itself, but when the applied energy increases, that part becomes very high temperature. In the recording head used in the present embodiment, the temperature rise is approximately 40° C. in the ink discharge state and the temperature rises to approximately 80° C. in the so-called ink fail in which the ink is not present in the liquid path.

On the other hand, when the user is to exchange the head cartridge, the user depresses the cartridge exchange key of the key unit 106 shown in FIG. 3 so that the carriage is moved to the cartridge exchange position of the printer and the lock lever 105 for locking the cartridge 104 is released to allow the take-out of the cartridge 104. If the recording head is at a very high temperature by the heat stored therein, it is dangerous if the user grasps the head cartridge to take it out.

In the present embodiment, the limit at which the user does not feel hot is considered to be 70° C. in real temperature and a maximum error in the measuring system is considered to be 20° C., and the head exchange inhibit mode is made valid at 70−20=50° C. (see steps S7 and S9 of FIG. 8A). By taking the error into consideration in this manner, the real temperature would not exceed 70° C. even if the characteristic of the diode temperature sensor varies.

Figure 12:
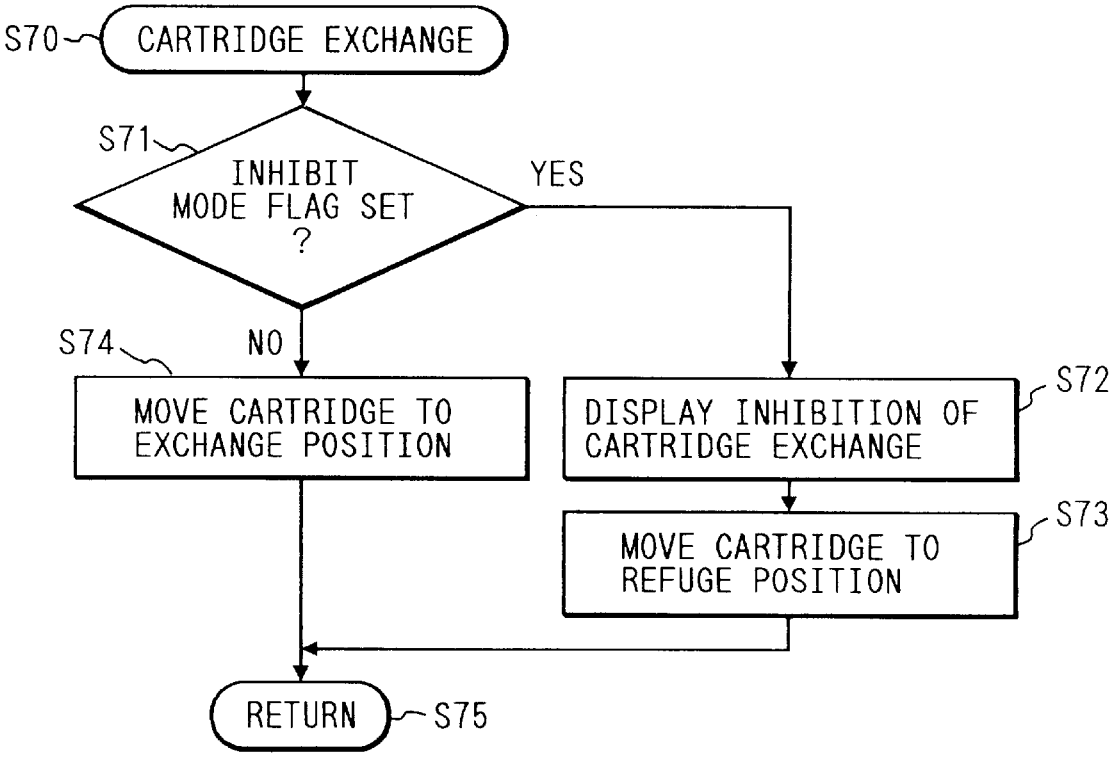
FIG. 12 shows a flow chart of the cartridge exchange sequence.

Referring to FIG. 12, the cartridge exchange sequence is explained.

In a step S9, if a flag to inhibit the cartridge exchange is set, the recording operation is continued if the recording is in process but when the user terminates the recording or attempts to interrupt the recording and enter the cartridge exchange mode, the flag is rendered valid. Specifically, when the cartridge exchange key is operated, the exchange sequence is started (step S80) and whether an inhibit mode flag is set or not is determined in a step S71. If it is set, the inhibit of the cartridge exchange is displayed in a step S72. Alternatively, it may be informed to a user by a buzzer. Simultaneously therewith, as shown in FIG. 4, the head cartridge is moved to the position covered by the barrier member 103 near the home position in a step S73 to make the lock lever 105 inoperable to prevent the carriage from being detached from the cartridge and prevent the user from touching the high temperature part. The present embodiment is characterized by the provision of both the means to inform to the user that the head exchange is not permitted and the mechanical code control means to prevent the head exchange.

A predetermined phase excitation of the carriage motor is also conducted to electrically fix the carriage.

As the means to prevent the exchange by the user, the lock lever itself may be locked to render the lock lever unmovable instead of providing the barrier member 103.

When the user attempts to forcibly pull out the carriage from the rear of the barrier member 103 to release the lock lever 105 to take out the cartridge, the carriage motor is driven to immediately return the carriage to the home position to disable the exchange of the cartridge. In this case, in order to determine whether the carriage is forcibly moved or not, the pull-out of the carriage from the barrier 103 to the position which allows the release of the lock lever 105 may be determined by the detection state of the home position sensor and a state as to whether a drive signal is then applied to the carriage drive motor or not.

Alternatively, when the carriage position is controlled by a linear encoder or a rotary encoder, the movement may be determined at the point when the encoder detects the movement. A counter emf generated when the carriage motor is driven may be detected to determine the movement of the carriage. The determination may be made by one of various methods and when the forced movement of the carriage is detected, the carriage is moved as shown by an arrow in FIG. 4 to move the head cartridge to the rear of the barrier member 103 or other equivalent cover or member to inhibit the exchange of the cartridge or the recording head.

On the other hand, if it is determined in the step S71 that the inhibit mode flag is not set, the cartridge is moved to the exchange position in a step S74 to allow the exchange by the user.

The setting of the determination temperature for the temperature overrise protect mode is now explained.

In the temperature overrise protect mode, a delayed recording flag is set to set a waiting time for each line of recording (see steps S13 and S14 in FIG. 8A). The further rise of the temperature is suppressed by the protect mode. The delayed recording or the operation to suppress the temperature rise may be conducted by other known methods instead of setting the waiting time between scans such as by reducing the number of discharge ports used per scan or reducing the drive frequency.

The recording head used in the present embodiment has the plastic molded grooved top plate 207 compress-fitted to the heater board 203. When the diode temperature sensor 206 detects the temperature of above 120° C., the grooved top plate 207 exceeds its thermal deformation point and it is deformed. For other structure, a break limit point is determined for the recording head by a difference between linear thermal expansion coefficiencies.

In order to keep the temperature below this temperature, the control may be made if a maximum error of the sensor system, a response frequency of the sensor system, a maximum delay time required for the control to interrupt and a maximum temperature rise during that period are known. In general, since the instant of sending the record data to the recording head for recording is so rapid that the sending of the record data to the recording head each time by the control of the MPU is too late, and the MPU merely sends a trigger signal to start the recording to the gate array which reads the bit image developed on the RAM in the DMA mode to send the signal to the recording head for recording. Accordingly, once the recording is started, the recording proceeds without the intervention of the MPU so that the recording may not be readily stopped immediately. Further, when the recording operation is stopped by the interruption, the next operation must start from the stopped portion and means and control therefor are needed.

From the above, it is advantageous in the control that the stopping of the recording operation and the setting of the waiting time are done at the completion of one scan of recording. Accordingly, if a maximum temperature rise in one scan is known, the determination temperature for the temperature overrise protect mode may be set to the limit operation temperature less the maximum temperature rise in one scan. Specifically, the temperature is set to be further lower than the above temperature by a maximum error of the temperature detection circuit. Thus, when the limit operating temperature is lower than 120° C., the maximum temperature rise in recording 8-inch width in one scan is 25° C. and the maximum error of the sensor system is 20° C., the determination temperature for the temperature overrise protect mode is 120−25−20=75° C.

As a result, when the temperature immediately before the recording is 74° C., for example, the delayed recording is not started and the temperature of the recording head is below 119° C. even if the sensor error is maximum. On the other hand, if the temperature immediately before the recording is 120° C., the delayed recording is started and the recording is started after the head temperature has dropped by the record waiting so that the head temperature does not exceed 120° C. When the divided recording is used for the delayed recording, the maximum temperature is suppressed to several °C. and the overall temperature rise so far is gradually decreased so that the head temperature does not exceed 120° C.

In this manner, in the present embodiment, the maximum temperature rise in one scan is previously acquired and the control is conducted by using the limit operating temperature less the maximum temperature rise as the reference temperature. More preferably, above temperature less the maximum error of the sensor system is used as the reference for the control so that the instant stop of the recording is prevented.

The temperature of 100° C. as the determination reference for the temperature overrise error mode is determined in the following manner. Namely, when the recording head is heated with no ink around the discharge heater of the recording head, when the high duty recording such as full painting by black is continued without noticing the empty heat state, when the control temperature value exceeds 100° C. due to variance of heat dissipation, or when the control temperature exceeds 100° C. when the sensor error is maximum, it is highly likely that the actual temperature of the recording head is above the limit temperature of 120° C. Accordingly, when the control temperature exceeds 100° C., it is determined as an error and the recording is immediately stopped (see step S20 of FIG. 8B).

Embodiment 2

The recording head of the Embodiment 1 allows the recording of 8-inch width per line. In the Embodiment 2 of the present invention, the temperature control is for a large recording apparatus which allows the recording of 16-inch width.

In a relatively large printer having the recording width if 16 inches, the number of discharge ports increases and the maximum temperature rise in one scan is approximately 45° C. as opposed to 25° C. for the 8-inch width. In this case, in accordance with the setting of the determination reference temperature explained in the Embodiment 1, the reference temperature is 120−45−20=55° C. In this case, when the recording is conducted at the environment temperature of 30° C. with the temperature rise in the apparatus being 10° C., the temperature rise of the recording head itself is permitted only for 55−30−10=15° C. Thus, even for the recording of a text, the recording head readily reaches the determination reference temperature by the temperature rise of its own and the process is shifted to the delayed recording mode which is the temperature overrise protect mode. As a result, the throughput is significantly reduced.

In the present embodiment, in order to solve this problem, at least one point at which the discharge control may interrupt is provided in one line of 16-inch width and a maximum temperature rise in one scan in the recording width between the points is previously measured.

For example, it is assumed that the maximum temperature rise when the 16-inch width is fully recorded in one scan is 45° C. It is also assumed that the temperature rise of the recording head is 75° C. by the continuation of the high duty recording. In this case, if one scan is recorded by using the all discharge ports in the 16-inch width, the temperature rise thereby is 45° C., and the total temperature rise is 75+45=

120° C. Thus, at the end of the scan, the grooved top plate may be fused and broken. Accordingly, for the 16-inch recording width, the control point to allow the stop of the ink discharge is provided at the 8-inch point so that the temperature rise is suppressed to 75+25=100° C. If it is known that the temperature rises 25° C. in one scan of the 8-inch width, it may be determined that the discharge need not be stopped at the 8-inch point if the temperature rise by the recording of the 8-inch width is lower than 120−25=95° C. In actuality, if the temperature rise is lower than the control temperature of 75° C. which is the temperature of 95° C. less the maximum error of 20° C. of the sensor system, the recording of the 16-inch width may be permitted.

When the discharge is stopped at the 8-inch point, the sheet is not fed in the next scan and the remaining portion is recorded. Since the position at which the discharge is stopped is predetermined, the control is not very complex. In the present embodiment, the stop point is only one although a plurality of points may be advantageously provided.

The present invention is particularly suitable for use in an ink jet recording head and a recording apparatus in which an electro-thermal transducer, a laser beam or the like is used to cause a change of state of the ink to eject or discharge the ink, because the high density of pixels and high resolution of recording are attained.

The typical construction and the operational principles are preferably the ones disclosed in U.S. Pat. No. 4,723,129 and U.S. Pat. No. 4,740,796. The principle and the structure are applicable to a so-called on-demand type recording system and a continuous type recording system. Particularly, however, it is suitable for the on-demand type because the principle is such that at least one driving signal is applied to an electro-thermal transducer disposed on a liquid (ink) retaining sheet or liquid passage, the driving signal being large enough to provide such a quick temperature rise beyond a departure from nucleation boiling point, by which the thermal energy is provided by the electro-thermal transducer to produce film boiling on the heating portion of the recording head, whereby a bubble can be formed in the liquid (ink) corresponding to each of the driving signals. By the generation, development and contraction of the bubbles, the liquid (ink) is ejected through a discharge port to produce at least one droplet. The driving signal is preferably in the form of pulse because the development and the contraction of the bubbles can be effected instantaneously, and therefore the liquid (ink) is ejected with fast response. The driving signal is preferably such as those disclosed in U.S. Pat. No. 4,463,359 and U.S. Pat. No. 4,345,262. In addition, the temperature rise rate of the heating surface is preferably such as those disclosed in U.S. Pat. No. 4,313,124.

The structure of the recording head may be those shown in U.S. Pat. Nos. 4,558,333 and 4,459,600 in which the heating portion is disposed at a bent portion, as well as the structure of the combination of the ejection outlet, liquid passage and the electro-thermal transducer disclosed in the above-mentioned patents. In addition, the present invention is applicable to the structure disclosed in Japanese Laid-Open Patent Application No. 59-123670 in which a common slit is used as the discharge port for a plurality of electro-thermal transducers, and the structure disclosed in Japanese Laid-Open Patent Application No. 59-138461 in which an opening for absorbing a pressure wave of thermal energy is formed corresponding to the discharge port. This is because the present invention is effective to perform the recording with certainty and high efficiency irrespective of the type of the recording head.

In addition, the present invention is applicable to a serial type recording head in which the recording head is fixed on a main assembly, to a replaceable chip type recording head which is connected electrically with the apparatus and can be supplied with the ink when it is mounted in the main assembly, or to a cartridge type recording head having an integral ink container.

The provision of the recovery means and/or the auxiliary means for the preliminary operation are preferable because they further stabilize the effects of the present invention. As for such means, there are capping means for the recording head, cleaning means therefor, pressurizing or suction means, and preliminary heating means which may be an electro-thermal transducer, an additional heating element or a combination thereof. Also, means for effecting preliminary discharge (not for the recording) may stabilize the recording operation.

As regards the variation of the recording head mountable, it may be a head for a single color or plural for a plurality heads of inks having different colors or densities. The present invention is effectively applicable to an apparatus having at least one of a monochromatic mode mainly with black, a multi-color mode with different color inks and/or full color mode using the mixture of colors, which may be an integrally formed recording unit or a combination of a plurality of recording heads.

Furthermore, in the foregoing embodiment, the ink is liquid. Alternatively, ink which is solidified below a room temperature and liquefied at a room temperature may be used. Since the ink is controlled within a temperature range of not lower than 30° C. and not higher than 70° C. to stabilize the viscosity of the ink to provide the stable discharge in a conventional recording apparatus of this type, the ink may be such that it is liquid within the temperature range when the recording signal is applied. The present invention is applicable to other types of ink. In one of them, the temperature rise due to the thermal energy is positively prevented by consuming it for the state change of the ink from the solid state to the liquid state. Another ink is solidified when it is left, unused, to prevent the evaporation of the ink. In any case, upon the application of the recording signal producing thermal energy, the ink is liquefied, and the liquefied ink may be discharged. Another ink may start to be solidified at the time when it reaches the recording sheet.

The present invention is also applicable to the ink which is liquefied by the application of the thermal energy. Such ink may be retained in liquid state or solid state in holes or recesses formed in a porous sheet as disclosed in Japanese Laid-Open Patent Application No. 54-56847 and Japanese Laid-Open Patent Application No. 60-71260. The sheet is faced to the electro-thermal transducers. The most effective one of the ink systems described above is the film boiling system.

The ink Jet recording apparatus may be used as an output terminal of an information processing apparatus such as a computer or the like, as a copying machine combined with an image reader or the like, or as a facsimile machine having information sending and receiving functions.

In accordance with the present invention, when the recording head reaches a relatively high temperature above the predetermined temperature, the exchange of the recording head is inhibited. Further, when the recording head reaches a high temperature, the drive duty of the recording head is reduced.

As a result, the safe recording apparatus which prevents the user from touching the high temperature member is provided. Further, the recording throughput is not reduced significantly.

Further, when the temperature of the recording head reaches the limit operating temperature less the maximum temperature rise in at least one line, the control is made to reduce the energy per unit time applied to the recording head for recording to prevent the break of the recording head.

While the invention has been described with reference to the structures disclosed herein, it is not confined to the details set forth and the present invention is intended to cover such modifications or changes as may come within the objects of the improvements or the scope of the claims.

What is claimed is:

1. A recording apparatus for recording on a recording medium by using an exchangeable recording head, comprising:

acquire means for acquiring temperature information of the recording head;

determination means for determining whether a head temperature value derived based on the temperature information of said recording head acquired by said acquire means is above a predetermined value or not;

receiving means for receiving a request to exchange said recording head;

moving and holding means for moving and holding said recording head beyond an exchangeable area; and control means for executing a mode to inhibit an exchange operation of said recording head when a request to exchange said recording head is received by said receiving means and said determination means determines that the temperature of said recording head is above the predetermined value, wherein in the mode to inhibit the exchange operation of said recording head, said recording head is inhibited from being exchanged with another recording heads, wherein recording is effected while moving said recording head, and inhibiting the exchange operation of said recording head is effected by said means for moving and holding said recording head beyond the exchangeable area, in which a user can exchange said recording head; in response to said receiving means receiving a request to exchange said recording head.

2. A recording apparatus according to claim 1, wherein said recording head is covered by a cover member in the exchangeable area.

3. A recording apparatus according to claim 1, wherein said recording head is locked by a lock mechanism in the exchangeable area to prevent said recording head from being removed.

4. A recording apparatus according to claim 1, wherein in the mode to inhibit the exchange operation, a control to move said recording head out of the exchangeable area is started when the recording head is moved from an area outside of the exchangeable area into the exchangeable area.

5. A recording apparatus according to claim 4, wherein movement of said recording head from an area outside of the exchangeable area into the exchangeable area is detected by an output from a home position sensor or an encoder or by detecting a counter emf of a motor during non-activation.

6. A recording apparatus according to claim 1, wherein in the mode to inhibit the exchange operation, a DC current or an increase in DC current is supplied to a motor for moving said recording head out of the exchangeable area at the time when said recording head is attempted to be moved from an area outside of the exchangeable area into the exchangeable area.

7. A recording apparatus according to claim 1, further comprising means for informing that the mode to inhibit the exchange operation of said recording head has been executed during said mode.

8. A recording apparatus according to claim 1, further comprising second determination means for determining whether the head temperature value derived based on the temperature information of said recording head acquired by said acquire means is above a second predetermined level representing a temperature at which said recording head is protected less a maximum temperature rise in one line of recording by the movement of said recording head or not, and second control means for relatively reducing an energy per unit time applied to the one line of recording when said second determination means determines that the temperature value of said recording head is above the second predetermined level.

9. A recording apparatus according to claim 8, wherein the second predetermined value is greater than the first predetermined value.

10. A recording apparatus according to claim 8, wherein said second control means effects at least one of reducing a drive frequency of said recording head for recording, recording by multi-pass or providing a rest period for recording.

11. A recording apparatus according to claim 1, wherein said recording head generates bubbles in ink by utilizing thermal energy and discharges the ink as the bubbles are generated.

12. A recording apparatus according to claim 11, further comprising suction means for sucking the ink.

13. A recording apparatus according to claim 1, further comprising a carriage to mount said recording head thereon.

14. A recording apparatus according to claim 1, wherein said recording apparatus is applied to a facsimile machine.

15. A recording apparatus according to claim 1, wherein said recording apparatus is applied to a copying machine.

16. A recording apparatus according to claim 1, wherein said recording apparatus is applied to a word processor.

17. A recording apparatus according to claim 1, further comprising:

second determination means for determining whether a head temperature value derived based on the temperature information of said recording head acquired by said acquire means is above a predetermined level representing a predetermined temperature at which said recording head is protected less a maximum temperature rise in one line of recording by movement of said recording head or not; and second control means for executing a mode for relatively reducing an energy per unit time for recording to perform the one line of recording when said second determination means determines that the temperature value of said recording head is above the predetermined level, wherein the recording is not interrupted during the one line of recording.

18. A recording apparatus according to claim 17, wherein the temperature information of the recording head includes an output of a sensor.

19. A recording apparatus according to claim 17, wherein said recording head generates bubbles in ink by utilizing thermal energy and discharges the ink as the bubbles are generated.

20. A recording apparatus according to claim 17, further comprising a carriage to mount said recording head thereon.

21. A recording apparatus according to claim 17, wherein said recording apparatus is applied to a facsimile machine.

22. A recording apparatus according to claim 17, wherein said recording apparatus is applied to a copying machine.

23. A recording apparatus according to claim 17, wherein said recording apparatus is applied to a word processor.

24. An apparatus according to claim 17, wherein said second control means effects at least one of recording by multi-pass and recording by providing a rest period in order to relatively reduce the energy per unit time for recording.

25. An apparatus according to claim 24, wherein in providing a rest period, said second control means causes said recording head to wait at a predetermined position for a predetermined period of time when said second determination means determines that the head temperature value of said recording head is above the predetermined level for each at least one line of recording.

26. An apparatus according to claim 24, wherein in recording by multi-pass, the number of discharge ports to be used by conducting divisional recording is reduced.

27. An apparatus according to claim 1, wherein recording is unaffected in the mode to inhibit the exchange operation of said recording head.

28. A recording method for recording on a recording medium by using an exchangeable recording head, comprising the steps of:

acquiring temperature information of said recording head;

determining whether a head temperature value derived based on the temperature information of said recording head acquired in said acquiring step is above a predetermined value or not;

receiving a request to exchange the recording head;

controlling a mode to inhibit an exchange operation of said recording head when said determination step determines that the temperature of said recording head is above the predetermined value, wherein in the mode to inhibit the exchange operation of said recording head, said recording head is inhibited from being exchanged with another recording head, wherein recording is effected while moving said recording head, and inhibiting the exchange operation of said recording head is effected by moving and holding said recording head beyond an exchangeable area, in which a user can exchange said recording head, in response to receiving a request to exchange said recording head in said receiving step.

29. A recording method according to claim 28, wherein said recording head is covered by a cover member in the exchangeable area.

30. A recording apparatus according to claim 28, wherein in the mode to inhibit the exchange operation, a control to move said recording head out of the exchangeable area is started when the recording head is moved from an area outside of the exchangeable area into the exchangeable area.

31. A recording method according to claim 30, wherein forced movement of said recording head from an area outside of the exchangeable area into the exchangeable area is detected by an output from a home position sensor or an encoder or by detecting a counter emf of a motor during non-activation.

32. A recording method according to claim 28, further comprising the step of informing that the mode to inhibit the exchange operation of said recording head has been set during said mode.

33. A recording method according to claim 28, further comprising a second step of determining whether the head temperature value derived based on the temperature information of said recording head acquired in said acquiring step is above a second predetermined level representing a predetermined temperature at which said recording head is protected less a maximum temperature rise in one line of recording by the movement of said recording head or not, and a step of relatively reducing an energy per unit time applied to the one line of recording when said second determination step determines that the temperature value of said recording head is above the second predetermined level.

34. A recording method according to claim 33, wherein the second predetermined value is greater than the first predetermined value.

35. A recording method according to claim 33, wherein said control step effects at least one of reducing a drive frequency of said recording head for recording, recording by multi-pass or providing a rest period for recording.

36. A recording method according to claim 28, further comprising the steps of:

a second step of determining whether a head temperature value derived based on the temperature information of said recording head acquired in said acquiring step is above a predetermined level representing a predetermined temperature at which said recording head is protected less a maximum temperature rise in one line of recording by movement of said recording head or not; and executing a mode for relatively reducing an energy per unit time for recording to perform the one line of recording when said second determining step determines that the temperature value of said recording head is above the predetermined level, wherein the recording is not interrupted during the one line of recording.

37. A recording method according to claim 36, wherein the temperature information of the recording head includes an output of a sensor.

38. A method according to claim 36, wherein the executed mode for relatively reducing an energy per unit time for recording effects at least one of recording by multi-pass and recording by providing a rest period in order to relatively reduce the energy per unit time for recording.

39. A method according to claim 38, wherein in providing a rest period, the executed mode for relatively reducing an energy per unit time for recording causes the recording head to wait at a predetermined position for a predetermined period of time when said second determining step determines that the head temperature value of the recording head is above the predetermined level for each at least one line of recording.

40. A method according to claim 38, wherein in recording by multi-pass, the number of discharge ports to be used by conducting divisional recording is reduced.

41. A recording method for recording on a recording medium by using an exchangeable recording head, comprising the steps of:

acquiring temperature information of said recording head;

determining whether a head temperature value derived based on the temperature information of said recording head acquired in said acquiring step is above a predetermined value or not;

receiving a request to exchange said recording head;

controlling a mode to inhibit an exchange operation of said recording head when said determination step determines that the temperature of said recording head is above the predetermined value, wherein in the mode to inhibit the exchange operation of said recording head, said recording head is inhibited from being exchanged with another recording head by supplying a DC current or an increase in DC current to a motor for moving said recording head out of the exchangeable area at the time when said recording head is attempted to be moved from an area outside of the exchangeable area into the exchangeable area.

42. A recording method for recording on a recording medium by using an exchangeable recording head, comprising the steps of:

acquiring temperature information of said recording head;

determining whether a head temperature value derived based on the temperature information of said recording head acquired in said acquiring step is above a predetermined value or not;

receiving a request to exchange the recording head;

controlling a mode to inhibit an exchange operation of said recording head when said determination step determines that the temperature of said recording head is above the predetermined value, wherein the recording is effected while moving said recording head, and in the mode to inhibit the exchange operation of said recording head, said recording head is inhibited from being exchanged with another recording head by holding said recording head beyond an exchangeable area in which a user can exchange said recording head, in response to an indication of a request to exchange said recording head.

* * * * *

UNITED STATES PATENT AND TRADEMARK OFFICE

CERTIFICATE OF CORRECTION

PATENT NO. : 5,940,094

DATED : August 17, 1999

INVENTOR(S) : OTSUKA ET AL.

It is certified that error appears in the above-identified patent and that said Letters Patent is hereby corrected as shown below:

COLUMN 12:

Line 51, "Jet" should read --jet--.

COLUMN 13:

Line 32, "heads," should read --head,--.

Line 38, "head;" should read --head,--.

Signed and Sealed this

Thirteenth Day of June, 2000

*Attest:*

Q. TODD DICKINSON

*Attesting Officer*

*Director of Patents and Trademarks*